United States Patent [19]

Horgan, Jr.

[11] 4,103,874

[45] Aug. 1, 1978

[54] RAILING ASSEMBLY

[75] Inventor: William J. Horgan, Jr., Pittsburgh, Pa.

[73] Assignee: Blumcraft of Pittsburgh, Pittsburgh, Pa.

[21] Appl. No.: 836,408

[22] Filed: Sep. 26, 1977

[51] Int. Cl.[2] ..... E04H 17/16

[52] U.S. Cl. ..... 256/24; 256/65; 52/400

[58] Field of Search ..... 256/24, 21, 22, 59, 256/65; 248/467, 473, 488, 494; 52/400

[56] References Cited

U.S. PATENT DOCUMENTS

| | | | |
|---|---|---|---|
| Re. 28,643 | 12/1975 | Blum | 256/59 X |
| 3,214,212 | 10/1965 | Horton | 52/400 |
| 4,067,548 | 1/1978 | Murphy | 256/65 |

*Primary Examiner*—Andrew V. Kundrat
*Attorney, Agent, or Firm*—Paul & Paul

[57] ABSTRACT

A railing assembly is disclosed, in which panels, preferably of glass construction are carried in the channel of a mounting structure, and which in turn support a handrail, with a preferred mounting residing in a sloped disposition of the channel-like mounting structure along or on a stairway, and wherein the panels are secured in the channel of the mounting structure by means of an adhesive, and with a flexible sheet material being provided for disposition within the channel, between its inside walls and the adjacent walls of the panel disposed therein, with portions of the sheet material being spaced apart from each other between opposite sides of the panel disposed in the channel and adjacent sidewalls of the channel and defining adhesive-receiving pockets therein, whereby adhesive applied in the pockets between the panel and the channel walls will be retained therein without running out, for facilitating setting of the adhesive even when the panels are slope-mounted as, for example, along a stairway.

7 Claims, 6 Drawing Figures

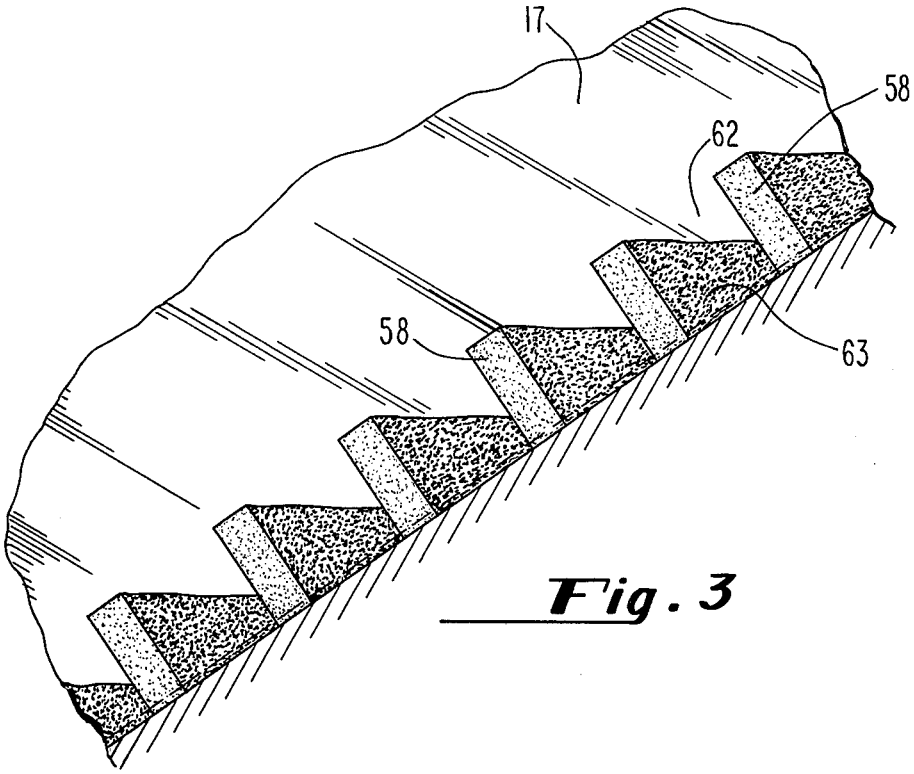
Fig. 3
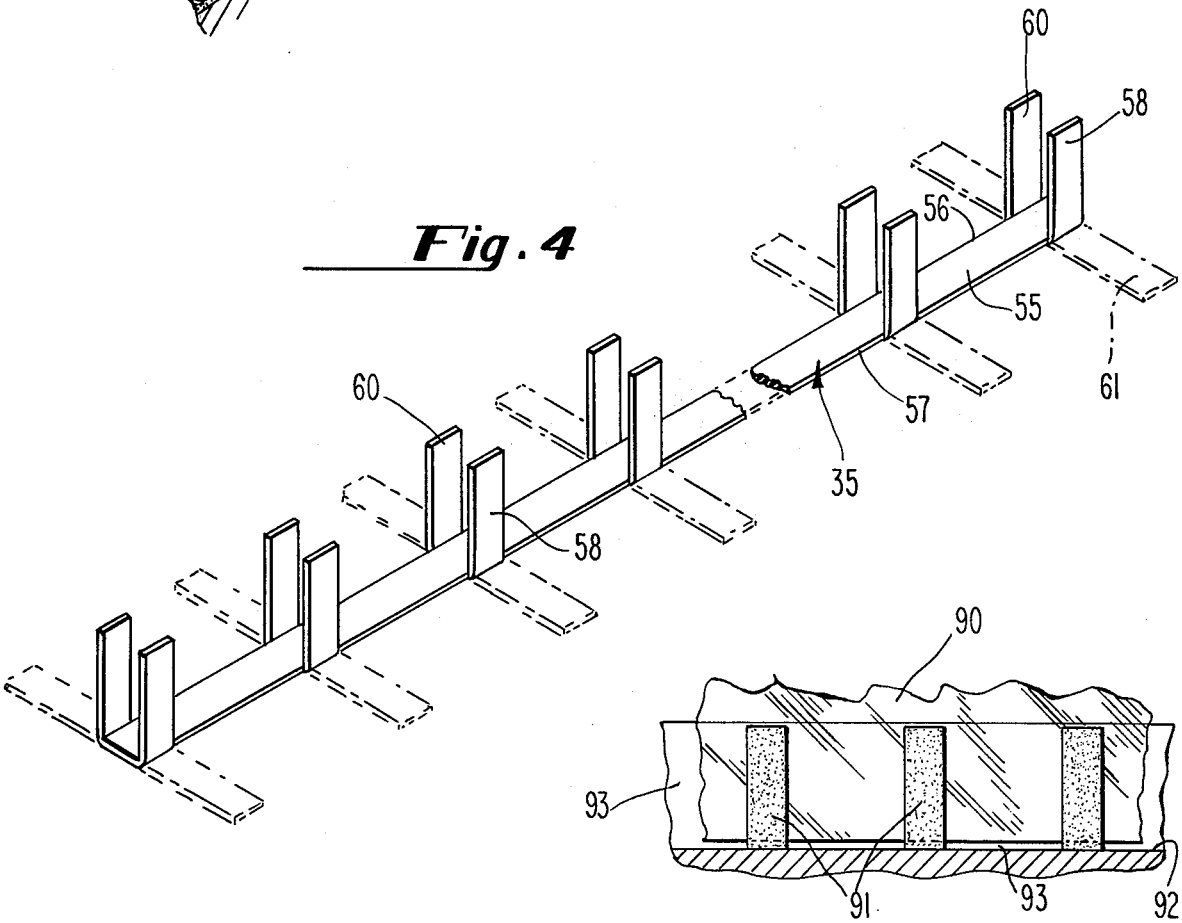
Fig. 4
Fig. 5

RAILING ASSEMBLY

BACKGROUND OF THE INVENTION

This invention is an improvement upon that of U.S. Pat. No. Re 28,643, the disclosure of which is herein incorporated by reference.

In the installation of railing assemblies, particularly, when the assemblies are slope-mounted, as for example, along or on a stairway or the like, and wherein the panels (preferably of glass construction) are to be adhesively secured within channels of the mounting structure, it is desired that the assemblies be effected prior to setting-up of the adhesive. Many of the available adhesives are more flowable in nature and require a period of time within which they can set up and positively adhere the panels to the channel walls. Most particularly, when the assemblies are mounted in sloped disposition, as on or along a stairway, and when it is desired to use the more liquid or flowable adhesives, it is desired to provide means whereby the assemblies may be made and installed without risk that the adhesive will, under the influence of gravity, run out of the channel before setting-up has taken place. Other times it is practical to work from one side only of a railing when installing it, but it is nevertheless desirable to have maximum adhesive contact between the panel and mounting channel.

SUMMARY OF THE INVENTION

The present invention is directed toward providing a means whereby adhesive may be received in pockets that are constructed to retain adhesive along those edges of the panel inside the channel until setting-up has taken place. To this end, a sheet material is provided for disposition about lower end portions of the channel, between the channel walls and the panel itself, with upwardly extending legs that serve to capture adhesive, even when the same is flowable in nature, and retain the same in place, even when the assembly is slope-mounted. The sheet material preferably has legs that are adhesively secured to the preferably glass panel, for insertion of the panel with the sheet material already applied thereto, into the channel, and with the pockets being formed by such legs being in spaced-apart relation to each other within the channel along each side of the panel. As an alternative, strips of sheet material (leg portions only) may extend from one side of a panel to the other, around the panel end. This latter construction allows for flow of adhesive that is applied in a pocket at one side of a panel around under the panel to the opposite side.

BRIEF DESCRIPTIONS OF THE DRAWINGS FIGURES

FIG. 3 is a fragmentary vertical sectional view taken through the mounting structure in accordance with the present invention, and wherein the adhesive-retaining pockets formed by upwardly opening legs of the pocket forming structure along one side of the panel, within the channel, are illustrated, the view being taken generally along the line III—III of FIG. 2.

FIG. 4 is a perspective view of the sheet pocket forming structure illustrated in FIGS. 2 and 3, with the legs thereof being shown in both phantom and full line positions, illustrating respectively, the foldable nature of the legs prior to, and after folding for disposition alongside the panel sidewalls.

FIG. 5 is a fragmentary sectional view through a panel-mounting channel, illustrating the use of alternative pocket-forming structure in the form of spaced-apart individual tapes extending around a lower end of a panel, from one side to the opposite side thereof.

DETAILED DESCRIPTION OF THE PREFERRED EMBODIMENTS

Figure 1:
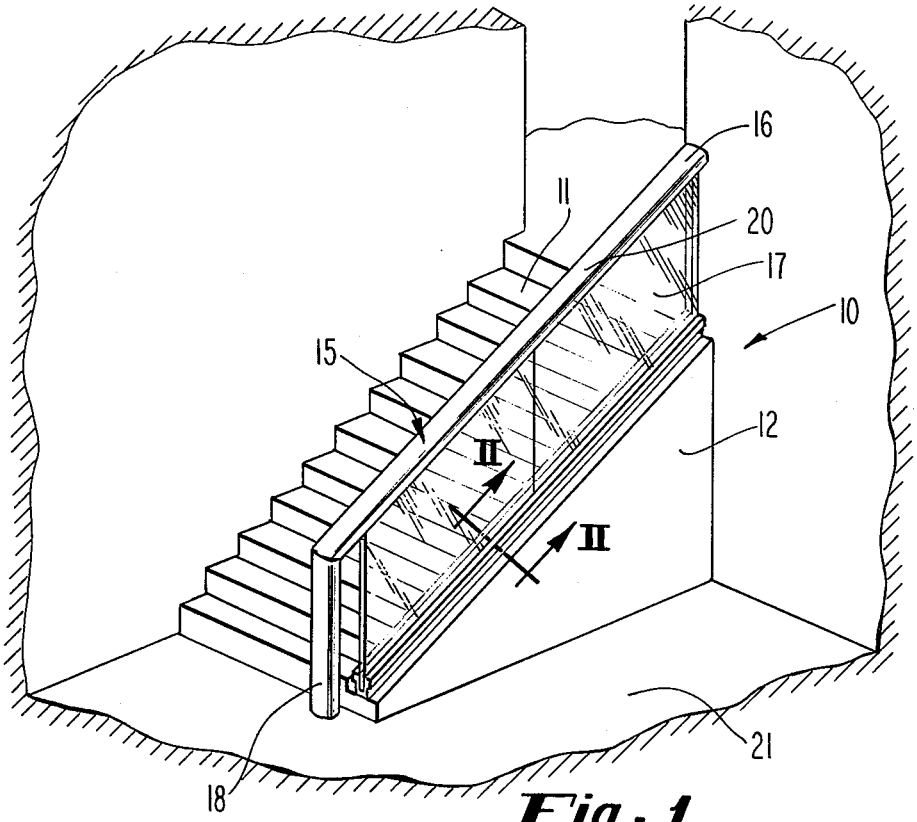
FIG. 1 is a perspective view of a railing assembly of the stairway-mounted type, constructed in accordance with the present invention.

Referring now to the drawings in detail, reference is first made to FIG. 1, wherein there is illustrated a building generally designated by the numeral 10, including a stairway 11, and an adjacent building structural portion 12, of concrete or like construction, having a sloped upper surface 13, to which the mounting structure 14 of the railing assembly 15 is mounted.

The railing assembly 15 includes a handrail 16, handrail supporting means 17 of the panel type, and the mounting means or structure 14.

The handrail 16 may be more or less rigid, as desired, and preferably continuous, and may be provided with an end portion 18 connecting the sloped portion 20 to a floor 21, as desired. In many instances, the sloped portion 20 of the handrail will be of less rigid, or thinner construction, for aesthetics and will receive rigidifying support from the handrail supporting means 17.

Figure 2:
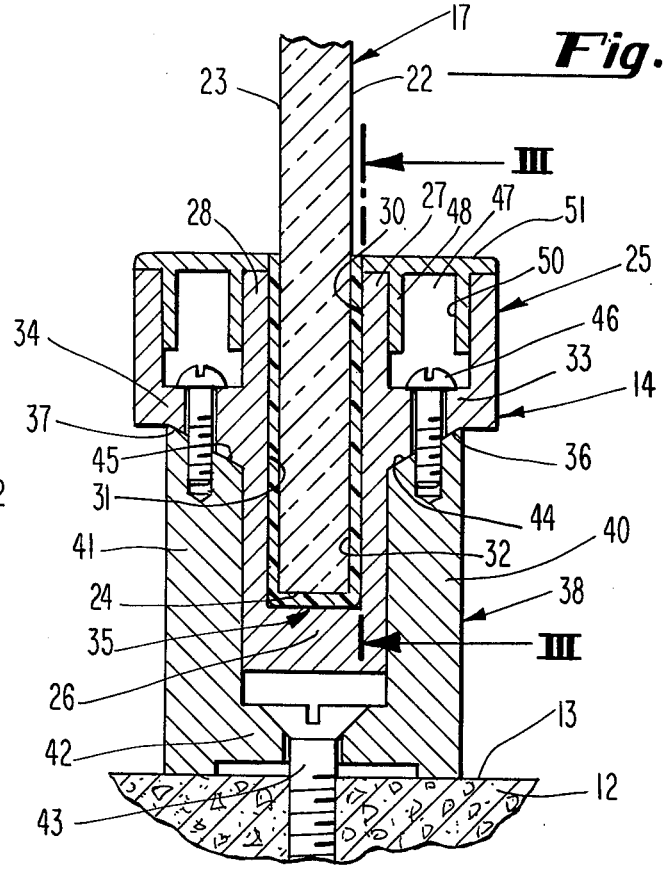
FIG. 2 is a fragmentary vertical sectional view of the lower end of a glass panel and a two piece channel bracket type of mounting structure, taken generally along the line II—II of FIG. 1.

The handrail supporting means will generally comprise one or more panels, and most preferably of glass construction, for ornamental purposes and for yielding desired visual effects. The panels 17 have opposed sides 22 and 23 connected at their lower ends by a lower edge 24 as shown in FIG. 2. The panels 17, if desired, may be constructed of other materials.

The mounting structure 14 will generally include a channel member 25, generally of U-shaped cross-sectional configuration as illustrated in FIG. 2, having a lower end 26, upstanding channel sidewalls 27 and 28 that define an elongated channel 30 therebetween, between opposite sidewalls 31 and 32 thereof, and outwardly extending mounting flanges 33 and 34 preferably integral with the sidewalls 27 and 28, respectively. The thickness of the channel 30 will generally be in excess of the transverse dimension of the panel 17 between its sides 22 and 23, for accommodating adhesive and legs of a pocket-forming member 35 therebetween. The lower surfaces of the flange portions 33 and 34 are generally sloped in an upwardly opening manner as is apparent at 36 and 37, for facilitating nesting of the channel member 25 within another channel-like structural receiving means or structure 38, also forming part of the railing mounting means in a preferred embodiment of the present invention.

The structural receiving means 38 is also of generally U-shaped transverse cross-section, as viewed in FIG. 2, and is provided with upstanding leg portions 40 and 41 connected by a lower web portion 42. Each of the members 25 and 38 are preferably of extruded construction.

The member 38 is adapted to be secured to the floor of preferably the sloped upper surface of the building structural portion 12, be means of suitable screw-type fasteners 43, as illustrated in FIG. 2.

The sloped lower surfaces 36 and 37 of the channel member 25 are adapted to seat on correspondingly upwardly opening sloped surfaces 44 and 45 at the upper ends of legs 40 and 41 of the structural receiving member 38. The members 25 and 38 are preferably secured together by suitable threaded fasteners 46 traversing the flange portions 33 and 34 along their length.

Recesses 47 are provided along upper ends of the flange portions 33 and 34, for accommodating the heads of fasteners 46, and for receiving depending legs 48, 50 of recess covers 51 therein along opposite sides of the channel 25.

With reference to FIG. 4, the pocket-forming structure 35 is illustrated as comprising a preferably foldable sheet material having a longitudinally disposed strip portion 55 defined between longitudinally disposed edges 56 and 57 and opposed ends, and with a plurality of upwardly foldable legs 58 integrally connected therewith, with the legs 58 extending transversely of the portion 55, in spaced-apart relation to each other, as is illustrated for example, in FIG. 4, by some suitable dimensional spacing one from the other, and with the legs 58 being connected to the strip 55 along its side edges 56 and 57.

In the assembly of the panels 17 into the channel 25, in those instances in which it is desired to use a member 35, the member 35 is first disposed with its longitudinal strip portion 55 along the lower edge 24 of the panels, and with the legs 58 then being folded up along sides 22 and 23 of the panels 17, with the surfaces 60, 61 of the legs 58 being placed in adhesive connection with the surfaces 22 and 23 of the panels 17 because of an adhesive that is preferably preexistent on the surfaces 60 and 61 of the legs 58. It will be noted that, if desired, the adhesive for securing the strip 35 to the panels 17 may have a contact type adhesive completely along the surfaces 55, 60 and 61, applied prior to assembly, or upon manufacture of the tape 35, or in the alternative, if desired, the adhesive may be applied to portions or all of the surfaces 60 and 61 of the legs 58, and even to the upper surface 55 of the tape 35, at the time of assembly.

In any event, the strip 35 will normally be adhesively secured to the lower ends of the panels 17, and the panels 17 then inserted into the channel 30. Thereafter, an adhesive, even liquid and flowable in form may be applied along the lower surfaces 22 and 23 of the panels 17, into pockets 62 formed between the surfaces 22 and 23, the channel surfaces 30 and 31, and the legs 58, 60 of the structure 35, as illustrated in FIG. 3, with the adhesive 63 being captured in the pockets 62 thus formed, as illustrated in FIG. 3, whereby it can set up as a solid or near-solid structure.

It will be apparent from the foregoing that the adhesive 63 may be of any suitable, more or less liquid, or even of originally pasty or granular types, and the same will be captured as described above. Additionally, the legs 58, 60 may be disposed precisely opposite each other across the panels 17, or may be staggered as desired. Also, the legs 58, 60 while being generally upwardly extending as viewed in FIG. 3, need not be necessarily disposed at right angles to the longitudinal strip portion 55, but could be disposed at various angular dispositions relative thereto, even to the extent that, when disposed on panels and placed in a slope channel, they may be more precisely vertical than illustrated in FIG. 3.

Furthermore, it will be apparent that the assembly of panels into panel-supporting structures in accordance with the present invention may take the specific form illustrated in FIG. 2, or could take other forms wherever it is desired to adhesively secure panels into channel-like structures. For example, the structure 14 illustrated in FIG. 2 is essentially of a two-piece extrusion; channel member 25 and structural receiving member 38. In alternative form, a single channel member may be desired, and the principal features of the present invention equally usuable therewith.

Figure 2A:
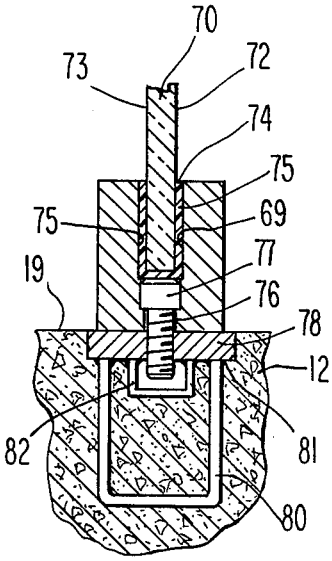
FIG. 2A is a fragmentary vertical sectional view of the lower end of a glass panel and an alternative one piece channel bracket type of mounting structure, in accordance with a preferred construction in accordance with the present invention, and taken along a line similar to that II—II of FIG. 1.

With particular reference to FIG. 2A, an alternative, and in many instances, preferred, mounting structure for use with the present invention is illustrated, in which a panel 70 is received within an essentially one-piece mounting means comprising a single bracket means 71 in the form of a channel member, upwardly opening around the lower edge of the preferably glass panel 70, as illustrated.

Spacing the lower outer surfaces 72 and 73 of the panel 70 from the interior surfaces 74 and 75 of the channel member 71 is a pocket-forming structure 35 as has previously been discussed in detail, and as is illustrated in FIGS. 3 and 4. The channel member 74 is provided with a series of spaced-apart holes 76 along its length, through which fasteners 77 pass to engage within a base plate 78 carried by a building structural portion 12, preferably of sloped upper surface 19.

The plate 78 is generally embedded in concrete or the like, by means of U-shaped bars 18 in welded connection to the lower surface of the plate 78, as at 81. U-shaped spacer means 82 is provided, to facilitate extension of the lower end of the fastener member 77, as illustrated in FIG. 2A. The lower end of the channel 69 has counter-drilled recesses for receiving the heads of the fastener members 77, spaced-apart along the channel, and with the panels 70 being bottomed in the channel 69, above the level of the upper ends of the fastener heads.

Assembly of the pocket-forming structure 35 about the panels 70 is precisely as aforesaid with respect to the embodiment of FIG. 2, and need not be duplicated herein.

It will be noted that the embodiment of FIG. 2A provides a simple and efficient manner of on-site assembly of glass or other suitable panels into a channel 71 that is disposed on a slope, as along a stairway such as is illustrated in FIG. 1, without running of adhesive out of the channel 69, but with the adhesive being captured in pockets 62 formed between panel surfaces, channel surfaces, and the legs of the pocket-forming structure 35.

With particular reference now to FIG. 5, it will be seen that an alternative pocket-forming structure is provided for mounting a panel 90 in a channel 92, by the use of individual strips 91 that extend from one side of the panel 90 around the bottom lower end or edge of the panel 90, to the opposite side. These strips may be in the form of adhesive surfaced tape or the like, and may be applied to the glass or other suitable panel prior to insertion of the panel 90 into the channel formed between its opposed walls 93, with those portions of the tapes 91 that are along the lower end or edge providing a slight spacing of the panel above the bottom surface 92 of the channel. The particular utility of this form of the invention resides when it is difficult to apply adhesive from both sides into the pockets formed between adjacent strips 91, as for example, when the panel 90 is used as part of a railing around a balcony. Generally, in such situations, it is difficult to apply adhesive from the outside of the balcony. In a construction in accordance with the present invention as set forth in FIG. 5, the adhesive may be applied from one side only of the panel 90, into the pockets formed between adjacent spaced-apart strips 91, with room being provided beneath the panel for adhesive to flow upwardly between the panel and the opposite sidewall of the channel, such that the adhesive will seek its own level within the channel, on both sides of the panel 90. Thus, an alternate pocket-forming structure is provided in the form of a plurality of individual tapes. It will be noted that in the embodiment illustrated in FIG. 5, for example, while the panel is shown in horizontal disposition, rather than a sloped disposition, the structure disclosed in FIG. 5 could work similarly in a sloped disposition of the panel 90, such as exists for the arrangement of FIG. 3.

It will further be noted that while the present invention is particularly adapted for use with sloped installation, such as the long stairways, it is equally adaptable for use wherever adhesive securing of panels in a channel member is desired, such as with railings of generally horizontal disposition.

It will be apparent from the foregoing that other modifications may be made in the details of construction, as well as in the use and operation of the present invention, all within the spirit and scope of the appended claims.

What is claimed is:

1. A railing assembly comprising a handrail, railing mounting means for connecting the handrail to a building structure, and handrail supporting means connecting said mounting means and said handrail; said handrail supporting means comprising at least one panel, said railing mounting means comprising bracket means in the form of a channel member having an upwardly opening channel therein, the lower edge portions of said panel being disposed within said channel, with the channel member having portions that extend up along lower opposite sides of the panel in bracketing relation therewith, and tape means disposed in said channel between said upwardly extending portions of said channel and said lower opposite sides of said panel, said tape means including a plurality of upwardly extending spaced apart strip portions defining therebetween upwardly opening adhesive-receiving voids, for receiving a liquified adhesive therein, and with a panel-securing adhesive disposed in said voids.

2. The assembly of claim 1, wherein said tape means comprises a sheet material having an adhesive thereon securing the tape to said panel, said tape means including a longitudinal portion disposed along a bottom edge of said panel, generally integral with said upwardly extending spaced apart strip portions.

3. The assembly of claim 1, wherein said assembly is in slope-mounted disposition along a stairway, and with the panel-securing adhesive in stepped disposition in said adhesive-receiving voids.

4. The assembly of claim 3, wherein the panel-securing adhesive is of a type that is in the liquid state upon application into the adhesive-receiving voids and which solidifies to a substantially solid state after application, whereby the panel-securing adhesive is captured in the adhesive-receiving voids of the slope-mounted assembly upon its application.

5. The assembly of claim 1, wherein said panel is of glass construction.

6. The assembly of claim 1, wherein said tape means comprises a sheet material having an adhesive thereon securing the tape to said panel, said tape means including a longitudinal portion disposed along a bottom edge of said panel, generally integral with said upwardly extending spaced-apart strip portions, wherein said assembly is in slope-mounted disposition along a stairway, and with the panel-securing adhesive in stepped disposition in said adhesive-receiving voids, wherein the panel-securing adhesive is of a type that is in the liquid state upon application into the adhesive-receiving voids and which solidifies to a substantially solid state after application, whereby the panel-securing adhesive is captured in the adhesive-receiving voids of the slope-mounted assembly upon its application, wherein said panel is of glass construction.

7. The assembly of claim 1, wherein said tape means comprises a plurality of unconnected strips, in adhesive securement to opposite sides of a said panel, and with portions of said strips extending around a lower end of said panel maintaining said panel in spaced relation above the bottom of said upwardly opening channel.

* * * * *